US011116273B2

(12) United States Patent
Rudd et al.

(10) Patent No.: US 11,116,273 B2
(45) **Date of Patent: *Sep. 14, 2021**

(54) HELMET FOR A HOCKEY OR LACROSSE PLAYER

(71) Applicant: BAUER HOCKEY, LLC, Exeter, NH (US)

(72) Inventors: David H. Rudd, Vaudreuil (CA); Thierry Krick, Côteau-du-Lac (CA)

(73) Assignee: BAUER HOCKEY, LLC, Exeter, NH (US)

( * ) Notice: Subject to any disclaimer, the term of this patent is extended or adjusted under 35 U.S.C. 154(b) by 229 days.

This patent is subject to a terminal disclaimer.

(21) Appl. No.: 16/283,315

(22) Filed: Feb. 22, 2019

(65) Prior Publication Data

US 2019/0184262 A1 Jun. 20, 2019

Related U.S. Application Data

(63) Continuation of application No. 15/363,150, filed on Nov. 29, 2016, now abandoned, which is a continuation of application No. 13/611,538, filed on Sep. 12, 2012, now Pat. No. 9,510,633, which is a continuation of application No. 12/408,084, filed on Mar. 20, 2009, now Pat. No. 8,296,867.

(60) Provisional application No. 61/038,547, filed on Mar. 21, 2008.

(51) Int. Cl.

| | |
|---|---|
| ***A42B 3/28*** | (2006.01) |
| ***A42B 3/06*** | (2006.01) |
| ***A42B 3/12*** | (2006.01) |
| ***A42B 3/32*** | (2006.01) |

(52) U.S. Cl.

CPC ..... *A42B 3/283* (2013.01); *A42B 3/062* (2013.01); *A42B 3/12* (2013.01); *A42B 3/281* (2013.01); *A42B 3/324* (2013.01)

(58) Field of Classification Search

CPC ..... A42B 3/324; A42B 3/062; A42B 3/12; A42B 3/281; A42B 3/283

See application file for complete search history.

(56) References Cited

U.S. PATENT DOCUMENTS

| | | | | |
|---|---|---|---|---|
| 3,314,077 A * | 4/1967 | Marchello | ..... | A42B 3/085 2/421 |
| 3,591,863 A * | 7/1971 | Rickard | ..... | A42B 3/085 2/415 |
| 3,629,864 A * | 12/1971 | Latina | ..... | A42B 3/324 2/420 |

(Continued)

*Primary Examiner* — Khaled Annis

(57) ABSTRACT

A helmet for receiving the head of a hockey or lacrosse player, the helmet having an outer shell and an inner lining covering at least partially the inner surface of the outer shell. In one embodiment, the helmet comprises a skeleton at least partially covered by the inner lining, a movable occipital pad and movable temple pads. The inner lining can be made of an absorptive material such as foam, expanded polypropylene or expanded polyethylene and can be overmolded onto the skeleton. The occipital pad and the temple pads may be arranged with an inward bias so as to help the helmet self-adjust to provide an advantageous fit on the player's head. In some embodiments, the outer shell and skeleton, or the outer shell and the inner lining, cooperate to define a ventilation system.

28 Claims, 13 Drawing Sheets

(56) References Cited

U.S. PATENT DOCUMENTS

| | | | | | |
|---|---|---|---|---|---|
| 3,720,955 | A * | 3/1973 | Rawlings | A42B 3/127 | 2/415 |
| 3,852,821 | A * | 12/1974 | Mickel | A42B 3/127 | 2/415 |
| 4,287,613 | A * | 9/1981 | Schulz | A42B 3/145 | 2/413 |
| 4,307,471 | A * | 12/1981 | Lovell | A42B 3/12 | 2/411 |
| 4,766,614 | A * | 8/1988 | Cantwell | A42B 3/124 | 2/171.3 |
| 5,930,840 | A * | 8/1999 | Arai | A42B 3/127 | 2/411 |
| 6,240,571 | B1 * | 6/2001 | Infusino | A42B 3/127 | 2/414 |
| 6,446,271 | B1 * | 9/2002 | Ho | A42B 3/12 | 2/414 |
| 6,665,884 | B1 * | 12/2003 | Demps | A42B 3/127 | 2/414 |
| 6,966,075 | B2 * | 11/2005 | Racine | A42B 3/324 | 2/418 |
| 2002/0035748 | A1 * | 3/2002 | Racine | A42B 3/324 | 2/414 |
| 2005/0034222 | A1 * | 2/2005 | Durocher | A42B 3/12 | 2/425 |

* cited by examiner

HELMET FOR A HOCKEY OR LACROSSE PLAYER

CROSS-REFERENCE TO RELATED APPLICATIONS

This application is a continuation of U.S. patent application Ser. No. 15/363,150 filed on Nov. 29, 2016, which is a continuation of U.S. patent application Ser. No. 13/611,538 filed on Sep. 12, 2012 now issued to U.S. Pat. No. 9,510,633, which is a continuation of U.S. patent application Ser. No. 12/408,084 filed on Mar. 20, 2009 now issued to U.S. Pat. No. 8,296,867, and which claims the benefit of U.S. Provisional Application No. 61/038,547, which was filed on Mar. 21, 2008. The contents of the above-noted applications are incorporated herein by reference in their entirety.

FIELD OF THE INVENTION

This application relates to a helmet for receiving the head of a hockey or lacrosse player.

BACKGROUND OF THE INVENTION

Protective helmets are worn in several types of sports and hazardous activities. Conventional types of helmets employ a rigid or semi-rigid outer shell that defines a space, which accommodates the head of the player. An inner lining, typically comprising one or more pads, is attached to an inner surface of the shell so as to be interposed between the shell and the head of the player. The shell and lining cooperate to provide a measure of protection from impact forces.

Since every player's head is different, one challenge with helmets is achieving a proper fit. In addition, in contact sports such as hockey, the fit of the helmet can be upset somewhat during play due to jostling and impact between players. In addition, due to the high speed of the game, player may not have the opportunity to realign a helmet during play. Additionally, significant heat is generated during spirited play of action sports. Conventional helmets tend to allow such heat to accumulate within the helmet causing discomfort and possibly affecting an athlete's performance. Further, since protection from impact forces is a main role of helmets, helmet makers are continually developing improved methods and structures for absorbing and dissipating impact forces so as to enhance protection of the player.

Accordingly, there is a need in the art for an improved hockey or lacrosse helmet that can substantially align itself on the player's head, has improved ventilation, and/or has improved impact absorption.

SUMMARY OF THE INVENTION

As embodied and broadly described herein, the present invention provides a helmet for receiving the head of a hockey or lacrosse player. The helmet comprises an outer shell for covering at least a portion of the head, the outer shell having an inner surface and an outer surface. The helmet further comprises a skeleton mounted within the outer shell, the skeleton having an inner surface and an outer surface, the skeleton comprising a plurality of members, each member having a bottom wall, and wherein one of the members has a projection extending upwardly from the bottom wall at an obtuse angle relative to the bottom wall and towards the inner surface of the outer shell. The helmet further comprises an inner lining at least partially covering the inner surface of the skeleton.

The present invention also provides a helmet for receiving the head of a hockey or lacrosse player. The helmet comprises an outer shell for covering at least a portion of the head, the outer shell having a front portion with a first ventilation aperture, a rear portion with a second ventilation aperture, an inner surface and an outer surface. The helmet further comprises a skeleton mounted within the outer shell, the skeleton having an inner surface and an outer surface, the skeleton comprising a plurality of members, wherein one of the members defines a channel that is in air communication with the first and second ventilation apertures such that, in use, airflow is provided within the channel. The helmet further comprises an inner lining at least partially covering the inner surface of the skeleton.

The present invention further provides a helmet for receiving the head of a hockey or lacrosse player. The helmet comprises an outer shell for covering at least a portion of the head, the outer shell having an inner surface and an outer surface. The helmet further comprises an inner lining at least partially covering the inner surface of the outer shell. The helmet further comprises a pad mounted adjacent the inner lining and covering a portion of the inner surface of the outer shell, the pad being movable between a first position and a second position, the second position being towards the interior of the helmet relative to the first position, the pad being biased to the second position such that, in use, when the player dons the helmet, the pad is deflected so that it exerts a force on the head of the player.

The present invention also provides a helmet for receiving the head of a hockey or lacrosse player. The helmet comprises an outer shell for covering at least a portion of the head, the outer shell having an inner surface and an outer surface. The helmet further comprises a skeleton mounted within the outer shell, the skeleton having an inner surface and an outer surface, the skeleton comprising a plurality of members, each member having a bottom wall, wherein one of the members comprises first and second projections, each projection extending upwardly from the bottom wall at an obtuse angle relative to the bottom wall and towards the inner surface of the outer shell, and wherein the first and second projections and the bottom wall define a channel. The helmet further comprises an inner lining overmolded onto the skeleton, the inner lining being made of foam and having an inner surface for contacting the head of the player.

These and other aspects and features of the present invention will now become apparent to those of ordinary skill in the art upon review of the following description of specific embodiments of the invention in conjunction with the accompanying drawings.

BRIEF DESCRIPTION OF THE DRAWINGS

A detailed description of the embodiments of the present invention is provided herein below, by way of example only, with reference to the accompanying drawings, in which.

Figure 1:
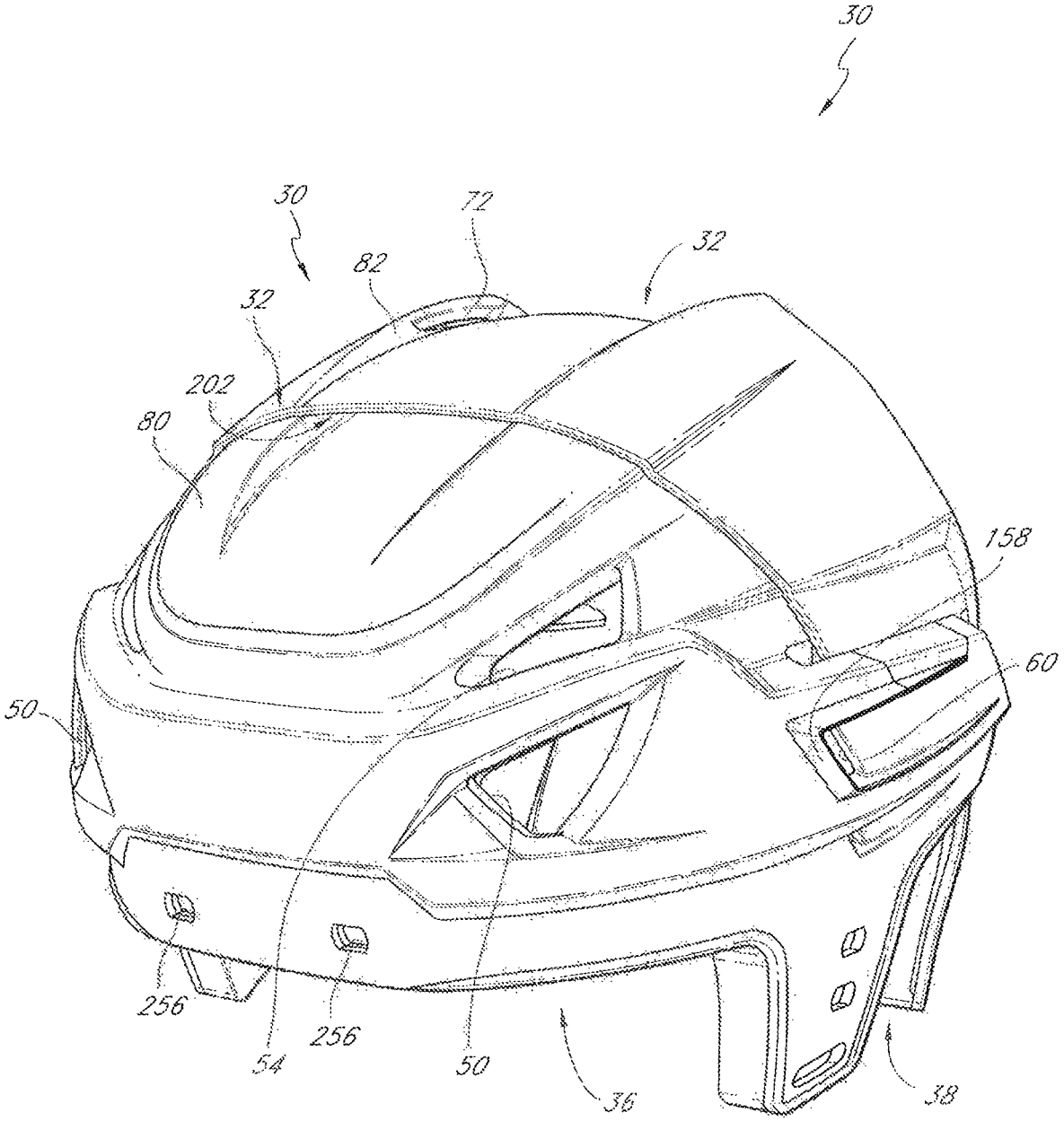
FIG. 1 is a front perspective view of an embodiment of a helmet having features in accordance with the present invention.

In the drawings, embodiments of the invention are illustrated by way of examples. It is to be expressly understood that the description and drawings are only for the purpose of illustration and are an aid for understanding. They are not intended to be a definition of the limits of the invention.

DETAILED DESCRIPTION OF EMBODIMENTS OF THE INVENTION

To facilitate the description, any reference numeral designating an element in one figure will designate the same element if used in any other figures. In describing the embodiments, specific terminology is resorted to for the sake of clarity but the invention is not intended to be limited to the specific terms so selected, and it is understood that each specific term comprises all equivalents.

Unless otherwise indicated, the drawings are intended to be read together with the specification, and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure. Similarly, the terms "inwardly," "outwardly" and "radially" generally refer to the orientation of a surface relative to its axis of elongation, or axis of rotation, as appropriate.

FIGS. 1 to 4 show various views of a helmet 30 according to one embodiment of the invention. The helmet 30 comprises an outer shell 32 that may be made of a relatively rigid material, such as polyethylene, NYLON, polycarbonate materials, thermoplastics, or thermosetting resins or any other suitable material. It is to be understood that several types of materials, such as fiber reinforced composite materials, extruded, molded, or cast materials and the like may be used for the shell.

The outer shell 32 has a front, a rear and opposing sides, an outer surface and an inner surface shaped to define a cavity 34 for receiving the head of a hockey or lacrosse player. A front face shield cavity 36 is formed at the front of the shell 32 and is configured to accommodate a face shield or face guard in front of the player's face. Ear cavities 38 are formed on either side of the helmet 30 and are configured to accommodate and/or fit the helmet around the player's ears. An occipital portion 40 of the helmet 30 is disposed at a rear of the helmet, and is configured to accommodate the lower head/upper neck of the player. A plurality of bolt apertures are also formed through the shell 32 so as to accommodate bolts extending therethrough for mounting other structures, such as a face shield, face guard, strap holders, and the like, onto the helmet 30.

Figure 2:
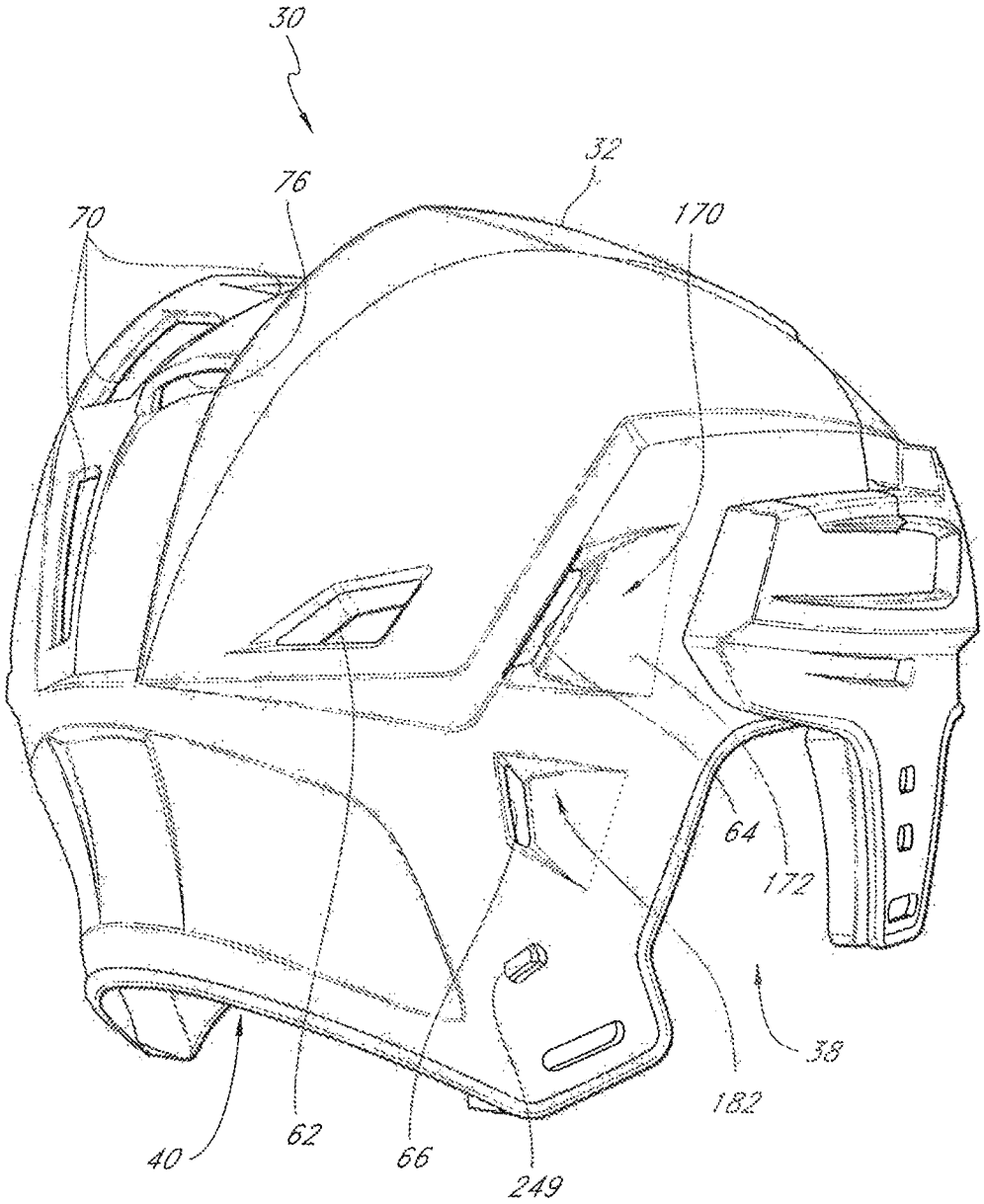
FIG. 2 is a rear perspective view of the helmet of FIG. 1.
Figure 3:
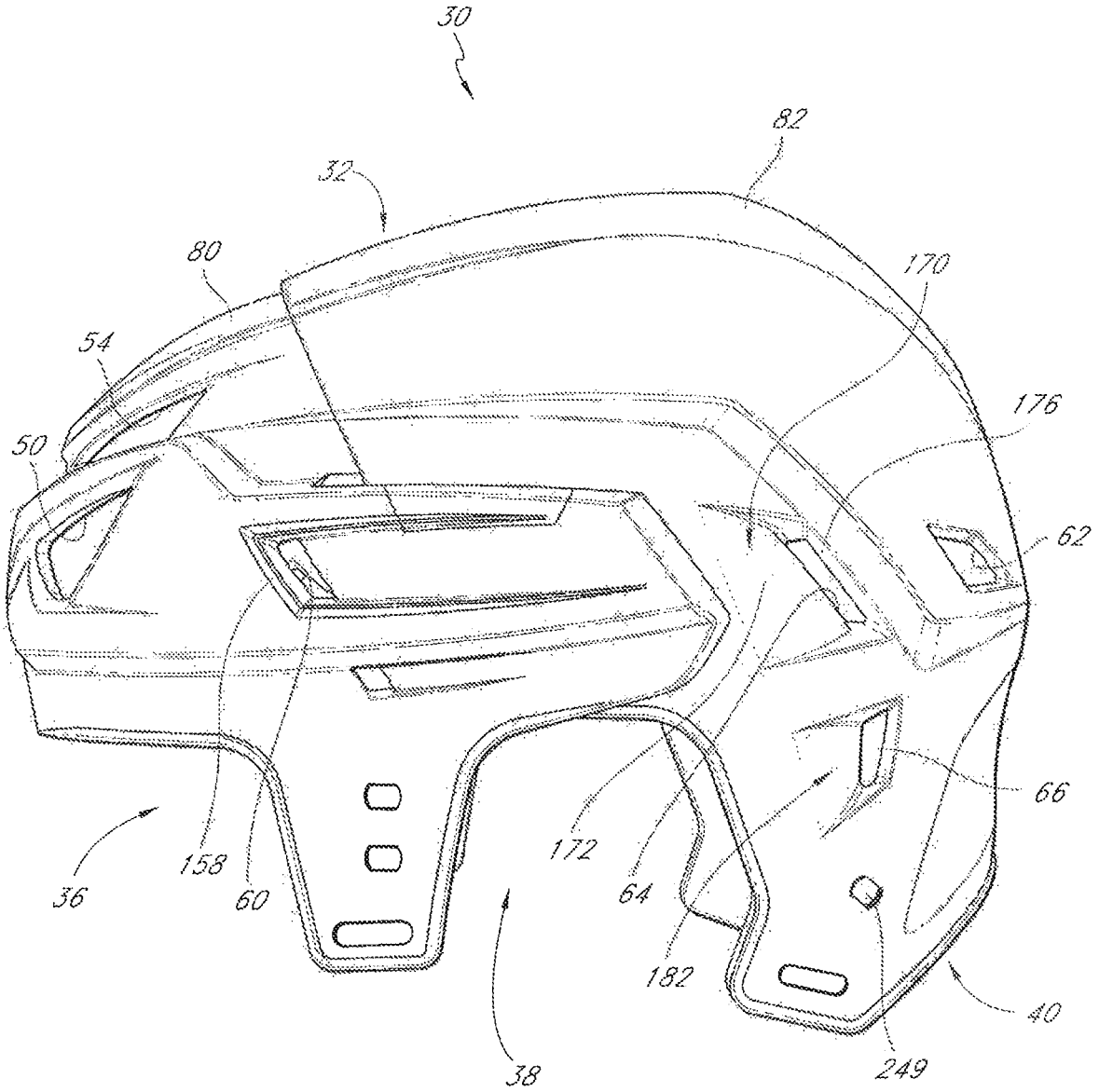
FIG. 3 is a side view of the helmet of FIG. 1.

Multiple ventilation apertures are formed through the outer shell 32 so as to provide added comfort by allowing air to circulate around the head of the player. As shown in FIGS. 1 and 3, the front portion of the shell 32 has a pair of first front ventilation apertures 50 formed to each side of a longitudinal axis of the shell and a pair of second front ventilation apertures 54 generally above the first front ventilation apertures 50. One or more side ventilation apertures 60 may also be formed along each side of the shell 32. As shown in FIGS. 2 and 3, the rear portion of the shell 32 has a pair of first rear ventilation apertures 62, a pair of second rear ventilation apertures 64 and a pair of third rear ventilation apertures 66 formed on opposing sides. An array of left and right middle ventilation apertures 70, 72 extend through the shell 32 along the top and back of the shell through a middle portion near the longitudinal axis of the shell 32. As shown in FIG. 2, a central rear ventilation aperture 76 is formed through the shell 32 between the left and right middle ventilation apertures 70, 72.

The helmet 30 is of an adjustable variety. More specifically, the outer shell 32 may be a two-piece shell having a front shell portion 80 and a rear shell portion 82. The front and rear shell portions 80, 82 are selectively movable relative to one another so as to adjust the size of the helmet 30 to customize it for the player and thus improve comfort and protection. It is to be understood, however, that in other embodiments a single-piece shell may be employed. In still further embodiments, a helmet shell having more than two pieces and/or being configured differently than in the illustrated embodiment can also employ inventive aspects discussed herein.

Figure 4:
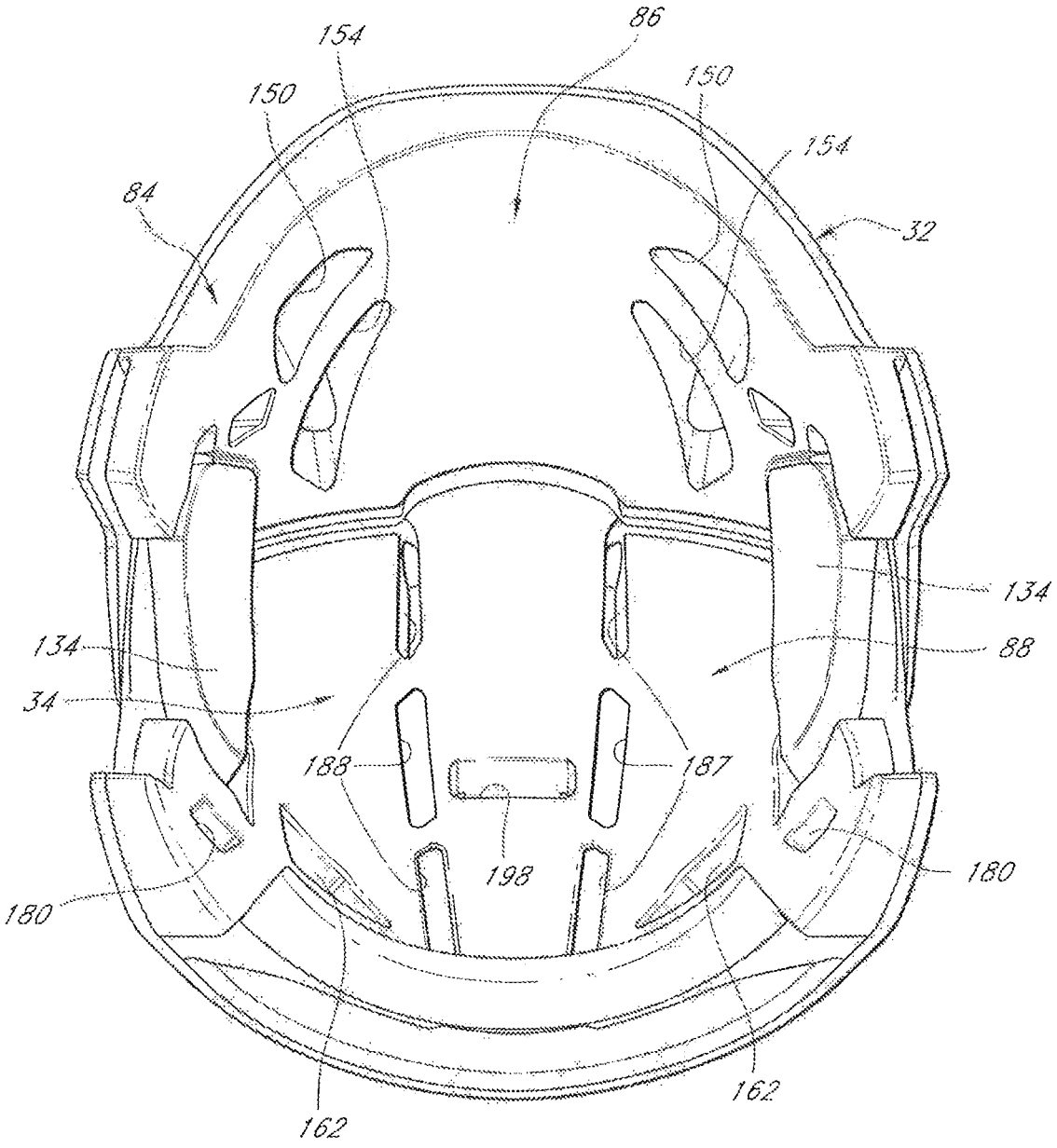
FIG. 4 a bottom view of the helmet of FIG. 1.
Figure 6:
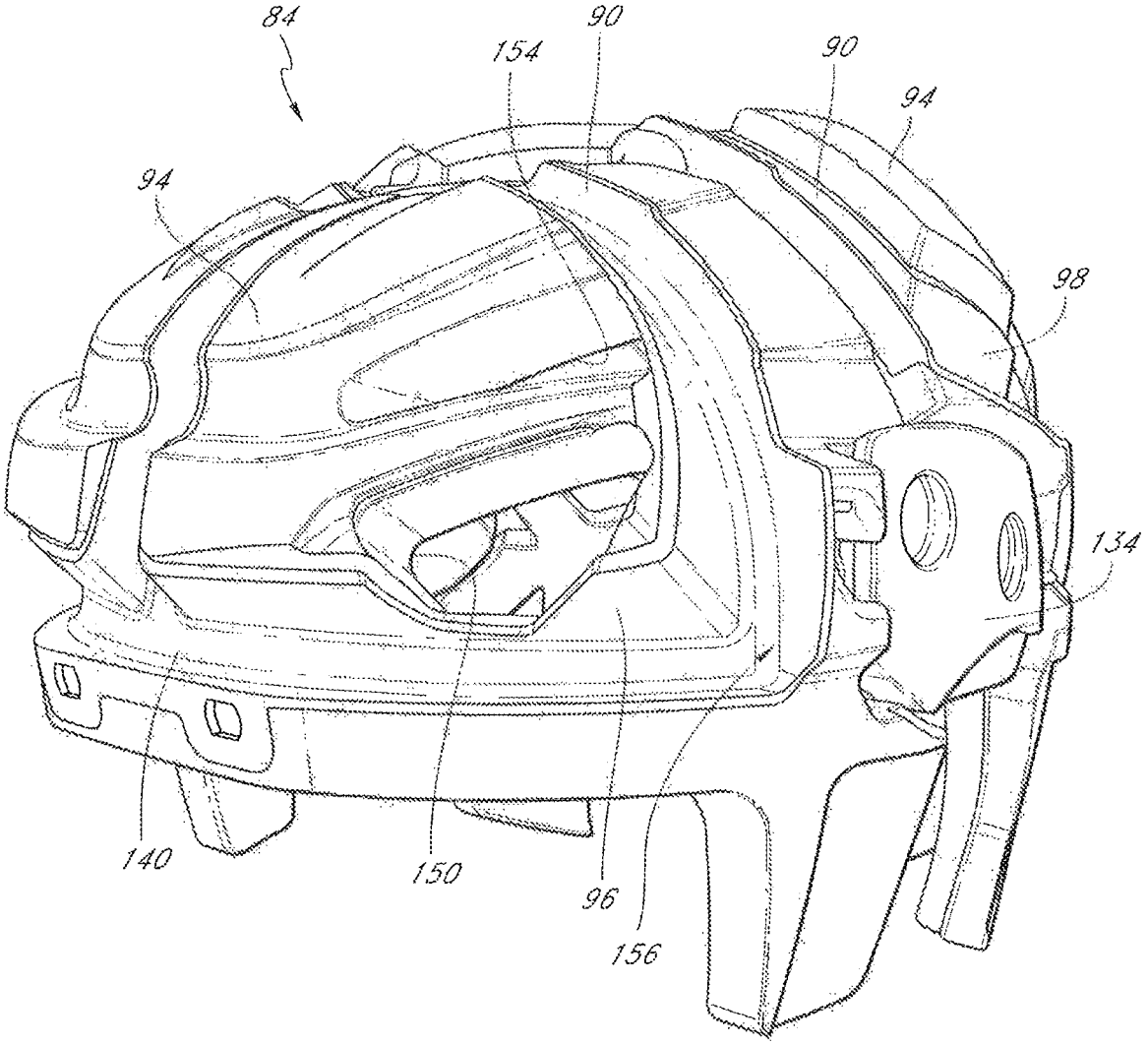
FIG. 6 is a front perspective view of an embodiment of an inner lining for use in the helmet of FIG. 1.
Figure 7:
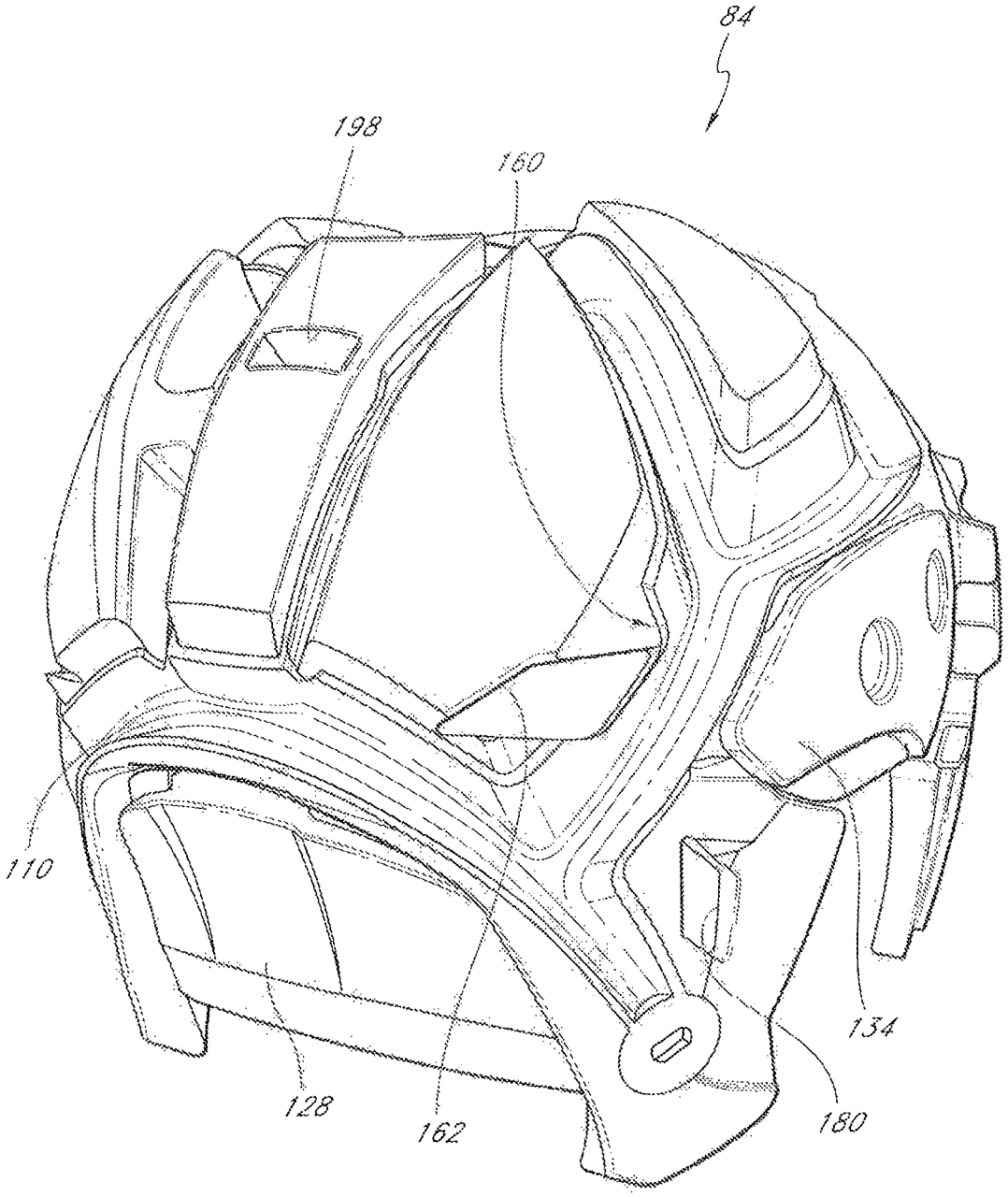
FIG. 7 is a rear perspective view of the inner lining of FIG. 6.

As shown in FIG. 4, the helmet 30 has an inner lining 84 mounted within the outer shell 32 and covering at least partially the inner surface of the shell 32. The inner lining 84 may comprise a front portion 86 and a rear portion 88. The inner lining 84 is illustrated without showing the shell 32 in FIGS. 6 to 9. As shown in FIGS. 6 and 7, the inner lining 84 may at least partially cover a skeleton 90. For example, the inner lining 84 can be overmolded onto the skeleton 90 and may then have several different padding elements 94 that fill cavities of the skeleton while the inner surface of the skeleton may be entirely or partially covered by the inner lining 84 such that the inner lining 84 has an inner surface for contacting the head of the player and such that each of the padding element 94 has an upper surface facing the inner surface of the outer shell 32. The inner lining 84 can be made of an energy-absorptive material such as foam, expanded polypropylene (EPP), expanded polyethylene (EPE), various plastic foams of various densities, combinations of these materials or any other energy-absorptive material suitable for use in protective gear.

Figure 8:
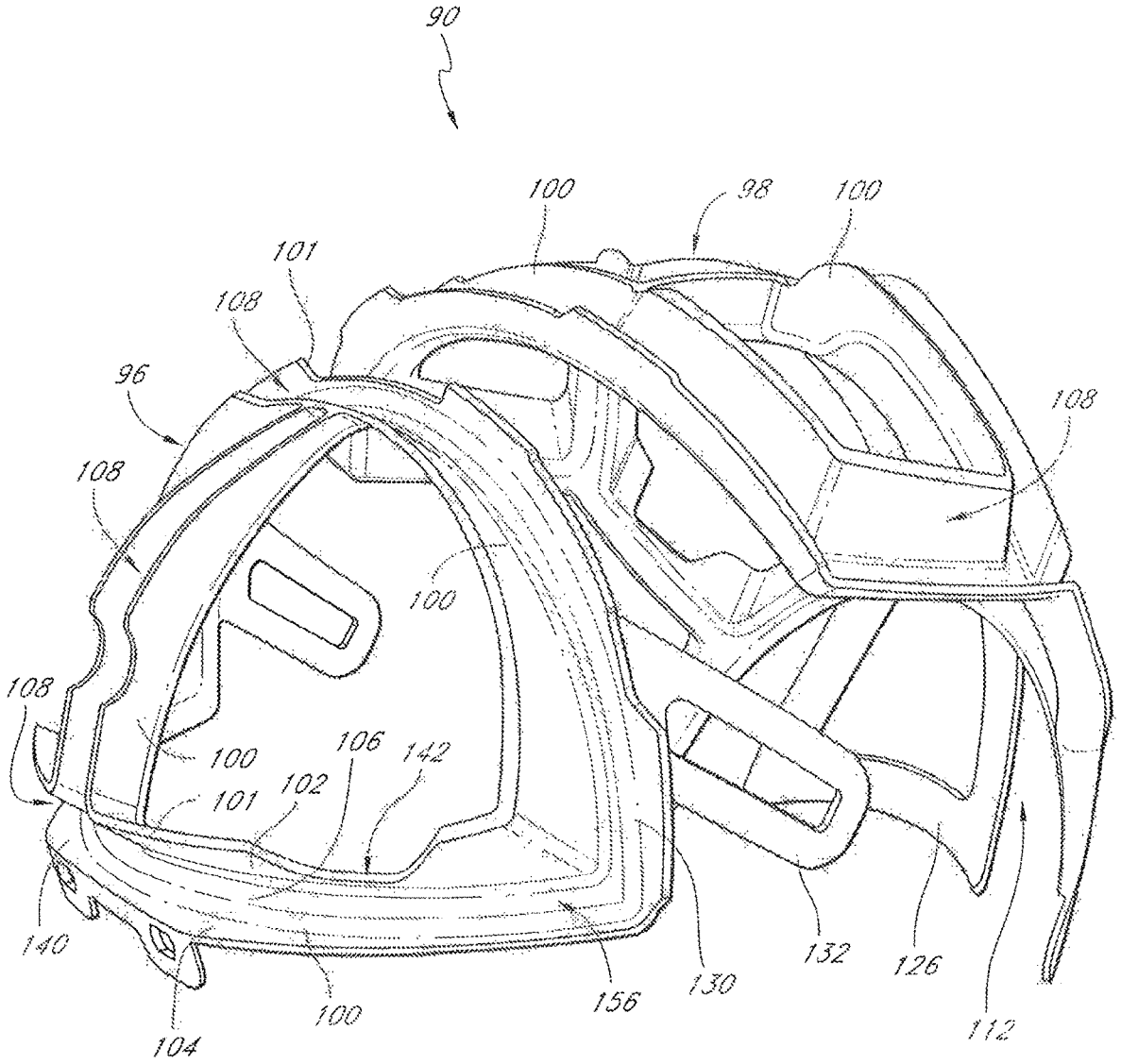
FIG. 8 is a front perspective view of an embodiment of a skeleton for use in the inner lining of FIG. 6.
Figure 9:
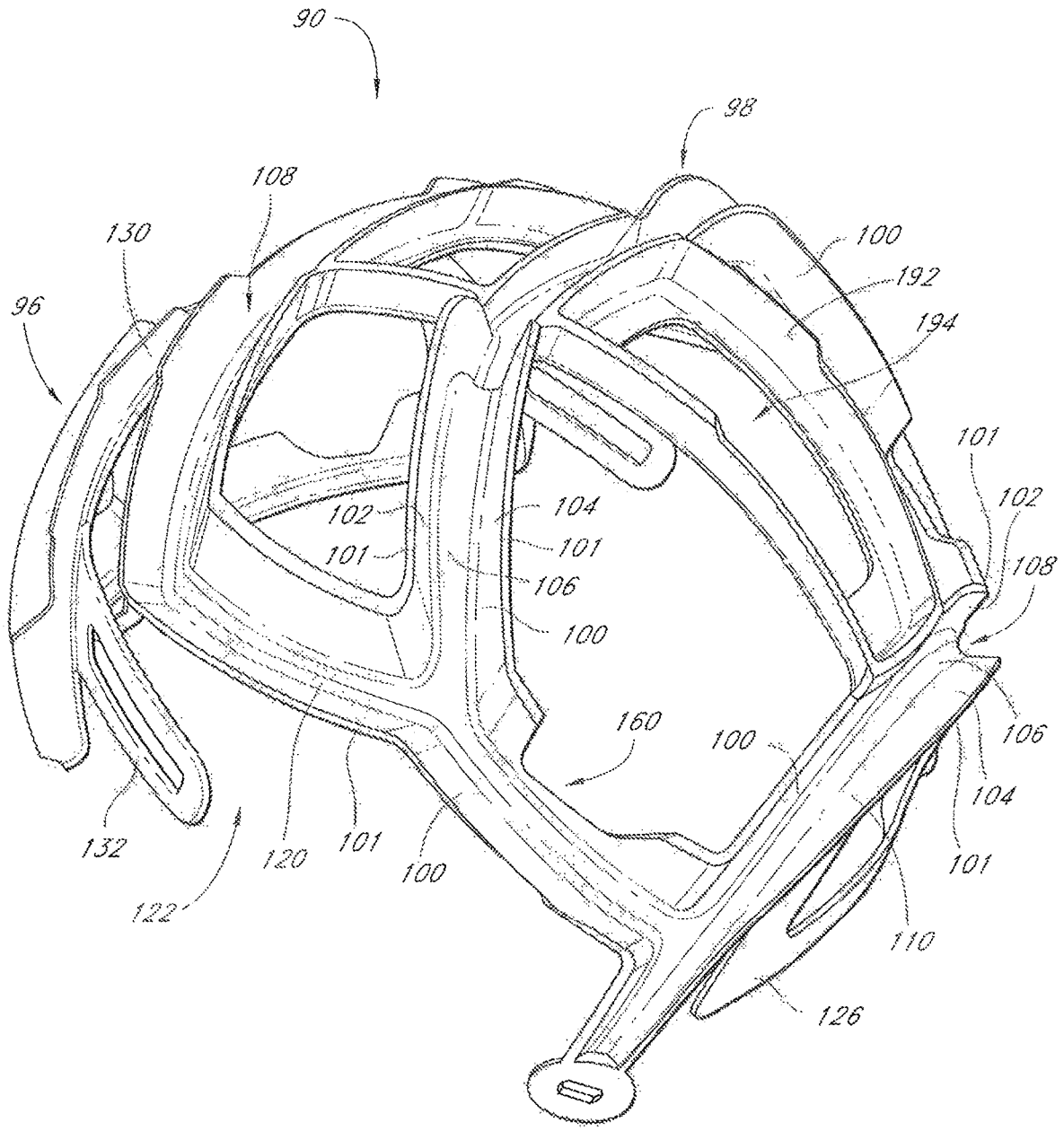
FIG. 9 is a rear perspective view of the skeleton of FIG. 8.

FIGS. 8 to 9 show the skeleton 90 without showing the inner lining 84. The skeleton 90 comprises a front skeleton portion 96 and a rear skeleton portion 98 that are formed separately from one another. The front skeleton portion 96 and rear skeleton portion 98 generally correspond to the front shell portion 80 and rear shell portion 82 of the outer shell 32. Thus, each skeleton portion 96, 98 is moveable with its associated shell portion 80, 82 in order to facilitate custom sizing for the player. It is to be understood that, in other embodiments, a single, unitary skeleton structure can be used. In still further embodiments, a skeleton structure having more than two separately-formed pieces may be employed as desired.

The skeleton portions 96, 98 can be made of a semi-rigid, injection-molded polymer. For example, polypropylene reinforced with fibers (e.g. glass fibers) can be used. Other materials such as metals, fiber reinforced composite materials of various kinds, extruded or molded polymers and the like can be employed. As illustrated, the skeleton 90 is formed of the front and rear skeleton portions 96, 98 that are each unitarily molded. In still other embodiments, skeleton portions can be constructed of multiple independently-formed pieces that are assembled together.

As shown, the skeleton 90 generally approximates the shape of the outer shell 32, and at least outer edge portions 101 of the skeleton face the inner surface of the outer shell 32. As such, the skeleton 90 provides substantial structural strength to the outer shell. The skeleton 90 may be bonded or otherwise attached to the shell 32. During impacts to the outer shell 32, impact forces are communicated from the outer shell 32 to the skeleton 90, and are communicated throughout one or both of the skeleton portions. This helps spread impact forces over a relatively large area and thus provides further protection for the player's head.

With continued reference to FIGS. 8 and 9, each of the skeleton portions 96, 98 comprises a plurality of skeleton members 100. Several of these members comprise opposing, spaced-apart first and second projections 102, 104 and a bottom wall 106, the first and second projections 102, 104 and the bottom wall 106 defining a channel 108. Each of the first and second projections 102, 104 extends upwardly from the bottom wall 106 at an obtuse angle relative to the bottom wall 106 and towards the inner surface of the outer shell 32. The projections 102, 104 are disposed at an angle relative to the bottom wall 106 that is slightly higher than 90° (e.g. between 91° and 110°). Thus, as impacts to the outer shell 32 are transmitted to the skeleton 90, instead of the skeleton passing such impact forces directly to the player's head, the first and second projections 102, 104 deflect, acting somewhat as a spring, and further absorbing impact forces before such forces are transmitted to the player's head. Thus, the skeleton 90 both distributes and absorbs localized impact forces.

The opposing projections 102, 104 are inclined in directions generally opposite to one another, forming a substantial V-shape or U-shape when taken in cross-section. Of course, in other embodiments, other cross-sectional shapes can be employed.

As best seen in FIGS. 6 and 7, the channels 108 of the skeleton 90 are open, that is to say, not filled with foam padding or the like of the inner lining 84. Thus, in use, a free airflow can be created through the channels 108. Further, multiple members 100 can be connected to one another, or integrally formed, in a manner so that their channels 108 are contiguous, thus eliminating resistance to air flow through the channels in each of the skeleton portions 96, 98.

As seen in FIGS. 8 and 9, the skeleton 90 comprises a central member extending along the longitudinal axis of the helmet at the front (see FIG. 8), a front transversal member 140 and a top transversal member 130 intersecting this central member at the front (see FIG. 8) and two transversal members and an occipital member 110 provided on the rear skeleton portion 98 (see FIG. 9), these members each having left and right projections 102, 104 and a bottom wall 106 defining a channel 108. The occipital member 110 extends transversely across the rear of the skeleton. The occipital member 110 defines an occipital cavity 112, which sits adjacent the lower head/upper neck of the player. Similarly, the rear skeleton 98 has a temporal member 120 along either side of the rear skeleton portion 98 generally above the area corresponding to the player's temple. A temporal cavity 122 of the skeleton 90 is defined below the temporal member 120 of the rear skeleton 98 and above the top of the ear cavity 38 of the outer shell 32, so as to be generally at the temple of the player's head.

As seen in FIG. 9, the skeleton 90 may have an occipital tab 126 extending from the occipital member 110 and into the occipital cavity 112. As seen in FIG. 7, an occipital pad 128 is attached to the occipital tab 126.

Figure 5A:
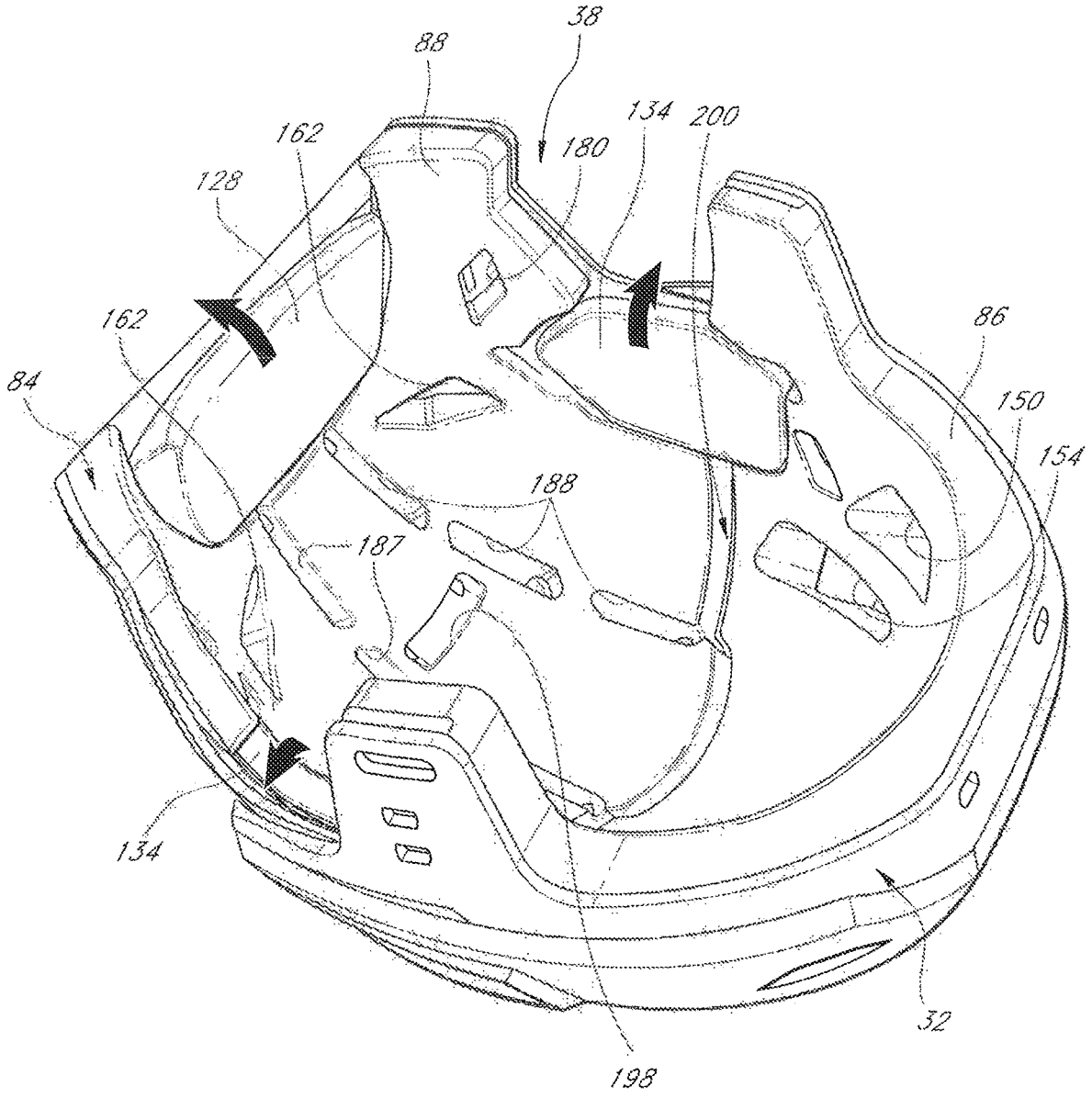
FIG. 5A is a bottom perspective view of the helmet of FIG. 1 with the pads 128, 134 shown in a first position.
Figure 5B:
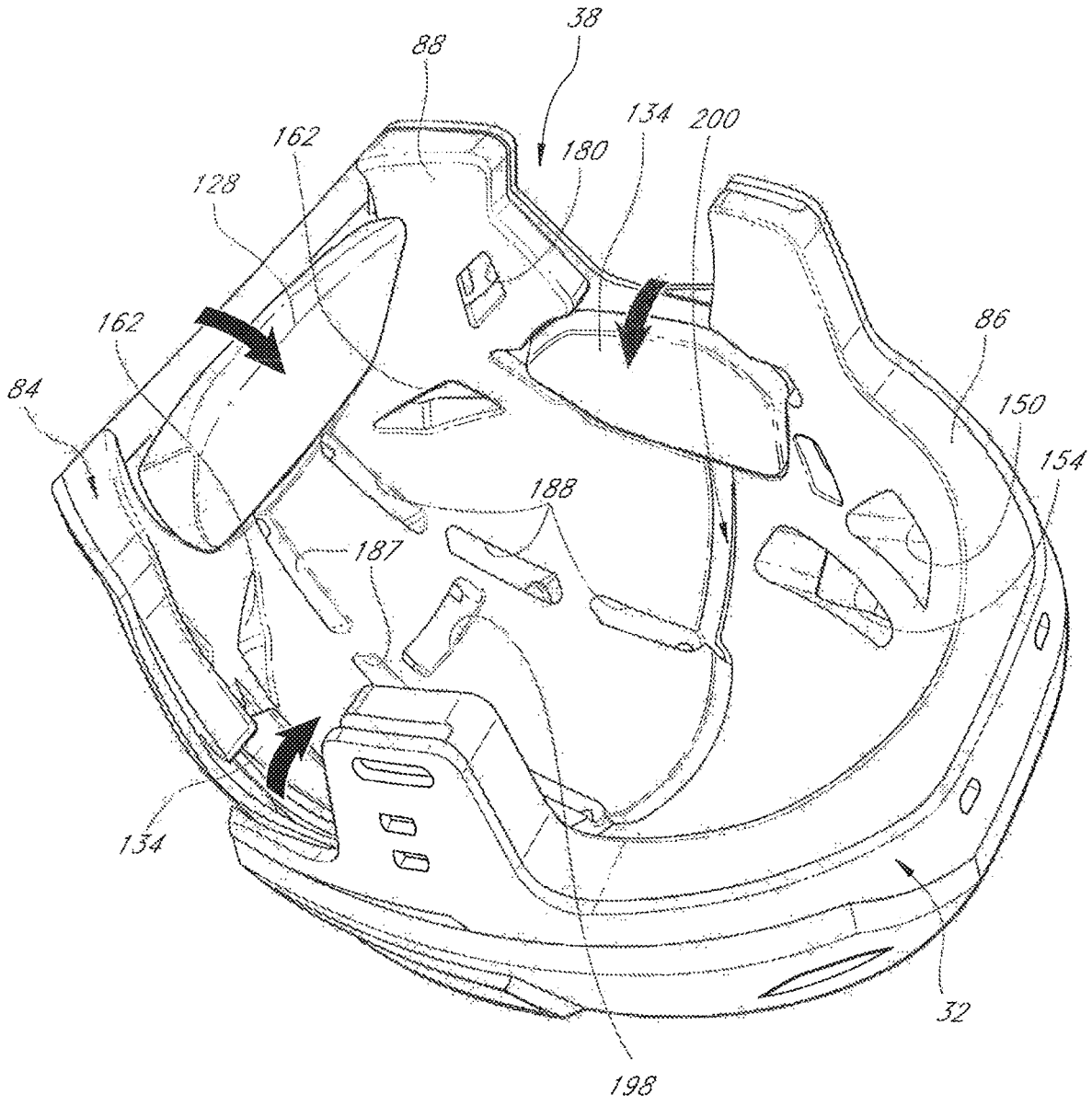
FIG. 5B is a bottom perspective view of the helmet of FIG. 1 with the pads 128, 134 shown in a second position.

The occipital pad 128 may be configured so that it is movable between a first position as shown in FIG. 5A and a second position as shown in FIG. 5B, the second position being towards the interior of the helmet relative to the first position, the occipital pad 128 being biased to the second position such that, in use, when the player dons the helmet, the pad 128 is deflected so that it presses against the lower head/upper neck of the player for exerting a force on the head of the player. The occipital tab 126 is sized and adapted to resist the deflection force and thus apply a gentle force to the player's lower head/upper neck through the pad 128, In the illustrated embodiment the occipital pad/tab 128/126 is biased to extend inwardly up to about one-half (½) inch from the inner surface of the outer shell 32, and thus there is sufficient space to accommodate deflection of the occipital pad 128 towards the first position when the player puts the helmet 30 on. In another embodiment, the occipital pad is biased to extend inwardly about one-quarter (¼) inch from the shell.

The occipital pad 128 can be overmolded onto the occipital tab 126 or can be affixed by any one of: gluing, bolting, riveting and stapling. It is to be understood that various manufacturing processes can be employed to form the occipital pad and attach it to the tab. Moreover, instead of being part of the skeleton, the occipital pad can be affixed to the inner lining or the outer shell while the pad is still biased inwardly such that, in use, when the player dons the helmet, the pad is deflected so that it exerts a force on the head of the player.

The deflection of the occipital pad 128 is distinct from the elastic crushing experienced by other pads when the player puts the helmet on in that the occipital pad 128 is supported by the occipital tab 126, so that rather than crushing the pad itself, the occipital tab 126 deflects due to the player's head.

As best seen in FIG. 8, the top transversal member 130 extends transversely across the rear of the front skeleton member 96. On each side a temporal tab 132 extends from the rear member 130 and generally into the temporal cavity 122, which is defined below the temporal member 120 of the rear skeleton portion 98.

As shown in FIGS. 6 and 7, a temporal pad 134 is attached to each temporal tab 132. Each temporal pad 134 may be configured so that it is movable between a first position as shown in FIG. 5A and a second position as shown in FIG. 5B, the second position being towards the interior of the helmet relative to the first position, the temporal pad 134 being biased to the second position such that, in use, when the player dons the helmet, the pad 134 is deflected so that it presses against the player's temple for exerting a force on the head of the player.

In the illustrated embodiment, the temporal pad 134 is biased to extend inwardly about one-quarter (¼) inch from the inner surface of the helmet outer shell 32. As such, there is sufficient space to accommodate deflection of the temporal pad 134 towards the first position when the player puts the helmet 30 on. In other embodiments the extent of the bias can be modified so as to be, for example, about one-eighth (⅛) inch or up to one-half (½) inch or more.

The temporal pad 134 can be overmolded onto the temporal tab 132 or can be affixed by any one of: gluing, bolting, riveting and stapling. It is to be understood that various manufacturing processes can be employed to form the temporal pad and attach it to the tab. Moreover, instead of being part of the skeleton, the temporal pad can be affixed to the inner lining or the outer shell while the pad is still biased inwardly such that, in use, when the player dons the helmet, the pad is deflected so that it exerts a force on the head of the player.

With reference again to FIGS. 4, 6 and 7, the front and rear portions 86, 88 of the inner lining 84 at least partially cover the inner surface of respective skeleton portions 96, 98 so as to provide padding for the player's head within the helmet. The portions 86, 88 may be unitary or made of a plurality of pad elements. In one embodiment, the skeleton portions 96, 98 are placed in a mold and foam material is injected over the respective front and rear skeleton members 96, 98 so as to bond to the skeleton members. Other padding layers may also be added. It is to be understood that in other embodiments different manufacturing processes can be employed. For example, several different inner linings or padding elements can be formed separately and later glued into place and/or bolted, riveted, stapled or the like onto the respective skeleton members.

In one embodiment, each of the skeleton portions 96, 98 is placed in a mold and foam is injected over the corresponding skeleton member. The temporal pads 134 are also injected over the temporal tabs 132 as desired and a separately-formed occipital pad 128 is bonded to the occipital tab 126. The assembled pads and skeleton members are then arranged in the outer shell 32 and bonded into place or otherwise attached to the shell 32.

As the player puts on the helmet 30, the inwardly-biased temporal and occipital pads 134, 128 engage the player's head and work together to self-adjust the positioning of the helmet and keep it in an optimal position. The optimal position maximizes the comfort for the player and also maximizes the predictability of helmet behavior on the player's head. Further, the self-adjusting features of the temporal and occipital pads 134, 128, working together, place the helmet 30 in an optimal position. The self-adjusting features resulting from the occipital and temporal pads working together is substantially more effective than any of the pads working alone. During play, the helmet 30 will not unduly bounce around on the player's head, but is kept in a proper position for potential impacts. Further, during jostling, as typically occurs with frequency during hockey play, if the helmet is jostled so as to change its orientation on the player's head, the inwardly biased pads 134, 128 work together to right the helmet and restore proper fit and adjustment without requiring a control action by the weaver. The inwardly biased pads 134, 128 at the occipital cavity 112 and the temporal cavity 122 exert self-adjustment forces in directions that are generally transverse to one another. This multi-directional biasing provides a secure and predictable fit of the helmet 30.

It is to be understood that, in other embodiments, inwardly-biased pads may be provided at still further locations, providing yet further transversely-directed self-adjustment forces to help customize and/or optimize the fit of the helmet. Also, in other embodiments, locations other than one or more of the occipital and/or temporal locations may be employed for inwardly-biased pads. For example, another embodiment may instead employ inwardly-biased pads at or near the forehead portion of the helmet in conjunction with inwardly-biased pads at or near the upper back of the head of the player. Further, as discussed above, although the illustrated embodiment includes the temporal tabs 132 extending from the front skeleton portion 96, which results in an inwardly-biased force, if temporal tabs extend from a different part of the skeleton, the direction of self-adjustment forces may be somewhat different, yet may still cooperate with the occipital self-adjustment force to achieve advantageous self-adjustment of the helmet. Still further, in other embodiments, biased padding may be attached to the shell, and the helmet may not include a skeleton, or may include a differently-configured and/or smaller skeleton. Nevertheless, multiple self-adjustment forces that are directed in transverse directions preferably will be exerted so as to help self-adjust the helmet position on the player's head.

Referring to FIGS. 6 and 8, the front transveral member 140 of the front skeleton member 96 has a first cutout 142 that corresponds to a first aperture 150 formed in the front portion 86. With reference also to FIG. 1, the first aperture 150 of the front portion 86 preferably corresponds to and aligns with the first ventilation aperture 50 of the outer shell 32. Thus, ventilation access is provided not only through the shell 32 and inner lining 84 to the player's head, but also to the channels 108 of the skeleton 90. The front portion 86 also comprises a second aperture 154 that aligns with the second front ventilation aperture 54 of the outer shell 32. However, in this embodiment the aligned second apertures 54, 154 do not access the channels 108. Thus, although some shell ventilation apertures communicate ventilation directly to the member channels, not necessarily all shell ventilation apertures communicate directly to member channels 108.

With particular reference to FIGS. 3 and 6, the side ventilation aperture 60 of the outer shell 32 preferably aligns with a side portion 156 of the channel 108 in the front skeleton portion 96. As such, air circulating within the channel 108 can vent out of the shell 32 through the side ventilation aperture 60. Further, due to its positioning on the side of the helmet 30, as a player skates at speed, air flowing front-to-back across the outside of the helmet 30 will flow across the side ventilation aperture 60. This air flow will establish a venturi effect, drawing air out of the skeleton channels 108, and ventilating such air to the atmosphere.

As shown, the side ventilation aperture 60 opens generally toward the rear. In contrast, the first front ventilation aperture 50 opens generally forwardly. Thus, during skating, air flows into the first front ventilation aperture 50 with momentum relative to the helmet 30 as a result of the player's forward speed. A portion of that air will enter the skeleton channels 108. Simultaneously, air flow across the side ventilation aperture 60 facilitates drawing air out of the skeleton channels 108. The first front ventilation apertures 50 and side ventilation apertures 60 thus cooperate to facilitate air flow into, out of, and through the front skeleton channels 108. As best seen in FIG. 1, the side ventilation aperture 60 faces generally rearwardly, and a portion 158 of the outer shell 32 protrudes outwardly to protect the side ventilation aperture 60 from entry of air flowing front-to-back across the helmet 30. It is to be understood that, in other embodiments, different configurations of the side ventilation aperture may be employed, and such an "exit" ventilation aperture is not even necessarily at the side of the helmet, but may be disposed at other locations, such as the top, rear, etc.

As discussed above, the aligned first front ventilation aperture 50 of the outer shell 32 and aperture 150 of the front portion 86 not only direct air into the front skeleton channels 108, but also direct air directly to a space within the helmet 30. More specifically, during use, a "helmet space" is defined as a space within the helmet between solid structures such as the skeleton 90, outer shell 32 or inner lining 84 and the player's head, but not including the skeleton channels 108. The aligned second front ventilation apertures 54 of the shell and aperture 154 of front portion 86 also direct air directly to the player's head in the helmet space. When the player is moving, air enters the helmet space with momentum, this facilitating a ventilating flow to the player's head and circulation of air that is already within the helmet space.

As seen in FIGS. 7 and 9, as with the front skeleton portion 96, the rear skeleton portion 98 may comprise members 100 that define channels 108 through which air can flow. In addition, a rear cutout 160 formed through a sidewall of a rear skeleton member 100 communicates the rear skeleton channels with aligned first rear apertures 162, 62 of the rear portion 86 and outer shell 32. Also, the player's head is accessible directly through the first rear aperture 162 of the rear portion 88. As such, both the player's head within the helmet space and the rear skeleton channels 108 communicate with the environment through the first rear ventilation aperture of the shell 32.

As shown in FIGS. 2 and 3, the outer shell 32 has an intake scoop 170 adapted to facilitate entry of air into the second rear ventilation aperture 64 as the player moves forwardly and air flows across the helmet in a front-to-back direction. The scoop 170 comprises an intake pathway 172 defined at least in part by an inwardly curved portion that leads air to the second rear ventilation aperture 64. As best seen in FIG. 3, the shell 32 has a raised portion 176 provided immediately behind the second rear ventilation aperture 64 to still further urge airflow into the second rear ventilation aperture 64. Airflow through the second rear ventilation aperture 64 is directed into the helmet space and a channel. Also, air can freely flow out of the rear channels and helmet space through the first rear ventilation aperture 62. Thus, there is provided both an inlet and an outlet to the channels 108 in the rear skeleton portion 98 and the helmet space. Such flow into the second rear ventilation aperture 64 and out of the first rear ventilation aperture 62 will help facilitate air circulation through the rear portion of the helmet 30.

With reference to FIGS. 2, 3, 4 and 7, the third rear ventilation aperture 66 is formed to the side and rear of the outer shell 32 and generally aligns with a third rear aperture 180 of the rear portion 88. As shown, the third rear ventilation aperture 180 does not communicate with the channels 108 of the rear portion 88. However, it provides direct access to the player's head. This ventilation access helps to ventilate the area around the player's ear and upper neck, including the area about the temporal pad 134. As shown in FIGS. 2 and 3, the outer shell 32 has a scoop 182 configured to help direct air into the third rear ventilation aperture 180 as air flows front-to-back across the helmet during skating as the player moves forward.

Referring to FIGS. 2, 4, and 7, air flow is also provided along the top of the helmet 30 due to the presence of the array of elongate left and right middle ventilation apertures 70, 72 along the top and back portion of the rear shell 82 and the elongated left and right middle apertures 187, 188 provided on the rear portion 88, which are generally aligned with corresponding ventilation apertures 70, 72. This provides a direct path from the player's head out of the helmet and into the environment. This structure is particularly amenable to ventilation of the player's head as hot air within the helmet space rises and flows out of the middle ventilation apertures. Such convection ventilation is enhanced by, for example, air being scooped into the helmet space through the front ventilation apertures 50, 54 and thus being readily available and having momentum to urge air already within the helmet space to flow out the apertures 187, 188, 70, 72.

Additionally, as best shown in FIGS. 7 and 9, the rear skeleton portion 92 has a middle member 192 with a fairly wide middle channel 194. A middle aperture 198 is also formed through the rear portion 88 so that the helmet space communicates with the middle channel 194. As best shown in FIG. 2, the central ventilation aperture 76 of the outer shell 32 communicates with the middle aperture 198 and opens generally rearward facing. As discussed previously, as air flows across the helmet 30 in a front-to-back direction, a venturi effect will draw air out of the central ventilation aperture 76, thus drawing air from within the helmet space through the middle aperture 198 of the padding and out of the helmet through the central ventilation aperture 76. As such, the helmet uses both direct ventilation from the aligned middle ventilation apertures 70, 72 and venturi-assisted ventilation through the central ventilation aperture 76 and other ventilation apertures in order to enhance ventilation and cooling.

As shown in FIGS. 5A and 5B, a space 200 may be provided between the front and rear portions 86, 88. As discussed above, the space 200 facilitates movement of the portions 86, 88 relative to one another during adjustment/sizing of the two-piece helmet. The space 200 may also enable additional ventilation. For example, as illustrated in FIG. 1, the outer shell 32 may comprise a front channel 202 defined between the overlapping front and rear shells 80, 82 at the top of the helmet. As such, the front channel 202 will scoop up air as the player skates forwardly for providing a flow of air into the helmet space. As such, a further supply of ventilation air into the helmet 30 is provided. As discussed above, there are multiple passageways for air to be ventilated from the helmet, and as the player moves forwardly, the ventilation can be enhanced through a structure that takes advantage of both the momentum of entering air and the venturi effect of air passing by a ventilation aperture.

The provision of multiple flow paths through portions of the helmet facilitates circulation of air while the player is being physically active. Typically while playing sports, air within a player's helmet absorbs heat from the player's head. Previously such air would be trapped within the helmet space or only ventilated by convection through holes formed in the top of the helmet. However, experience has shown that simply providing some holes through the top of a helmet has only limited benefits, and a significant volume of air tends to stagnate within the helmet, thus causing discomfort for the player. Due to the air circulation and ventilation facilitated by the positioning of ventilation apertures and channels as in the present embodiments, specifically, providing inlets and outlets that enable a venturi effect and take advantage of air momentum to still further facilitate ventilation during physical activity, such heated air generally does not stagnate, but is instead caught up in the airflow and ventilated through and out of the helmet.

As shown, channels formed by and through the skeleton 90 are provided for allowing air circulation. However, it is to be understood that not all embodiments must employ such a skeleton portion, and channels having features as discussed herein may be provided in embodiments not having such a skeleton. For example, in one embodiment, during molding of the inner linings, channels are provided within the inner linings in addition to ventilation apertures so as to facilitate the venturi effect and to facilitate flow paths into and out of the helmet shell to help further enhance circulation of air within the helmet.

Figure 10:
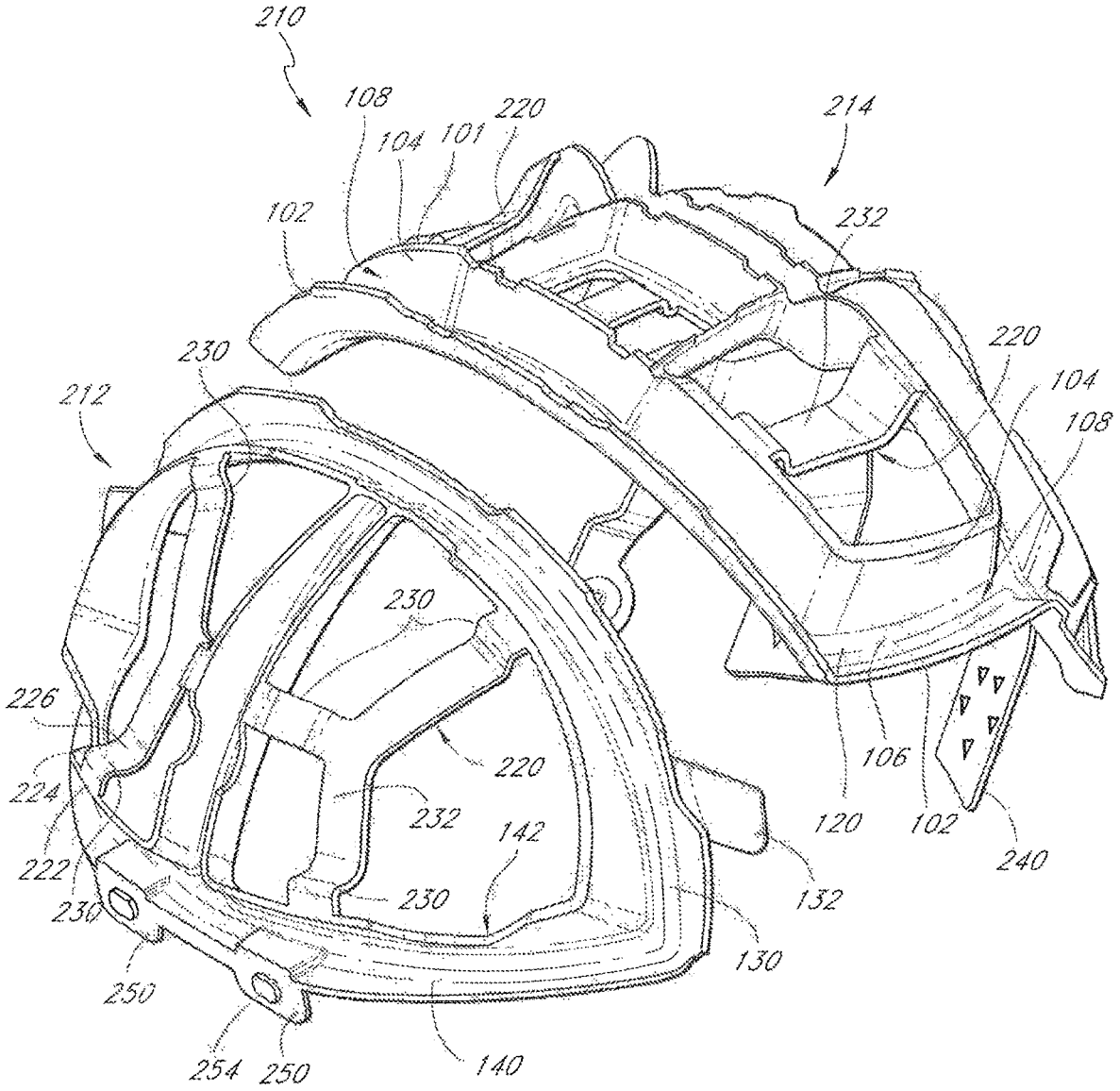
FIG. 10 is a front perspective view of another embodiment of a skeleton for use in the inner lining.
Figure 11:
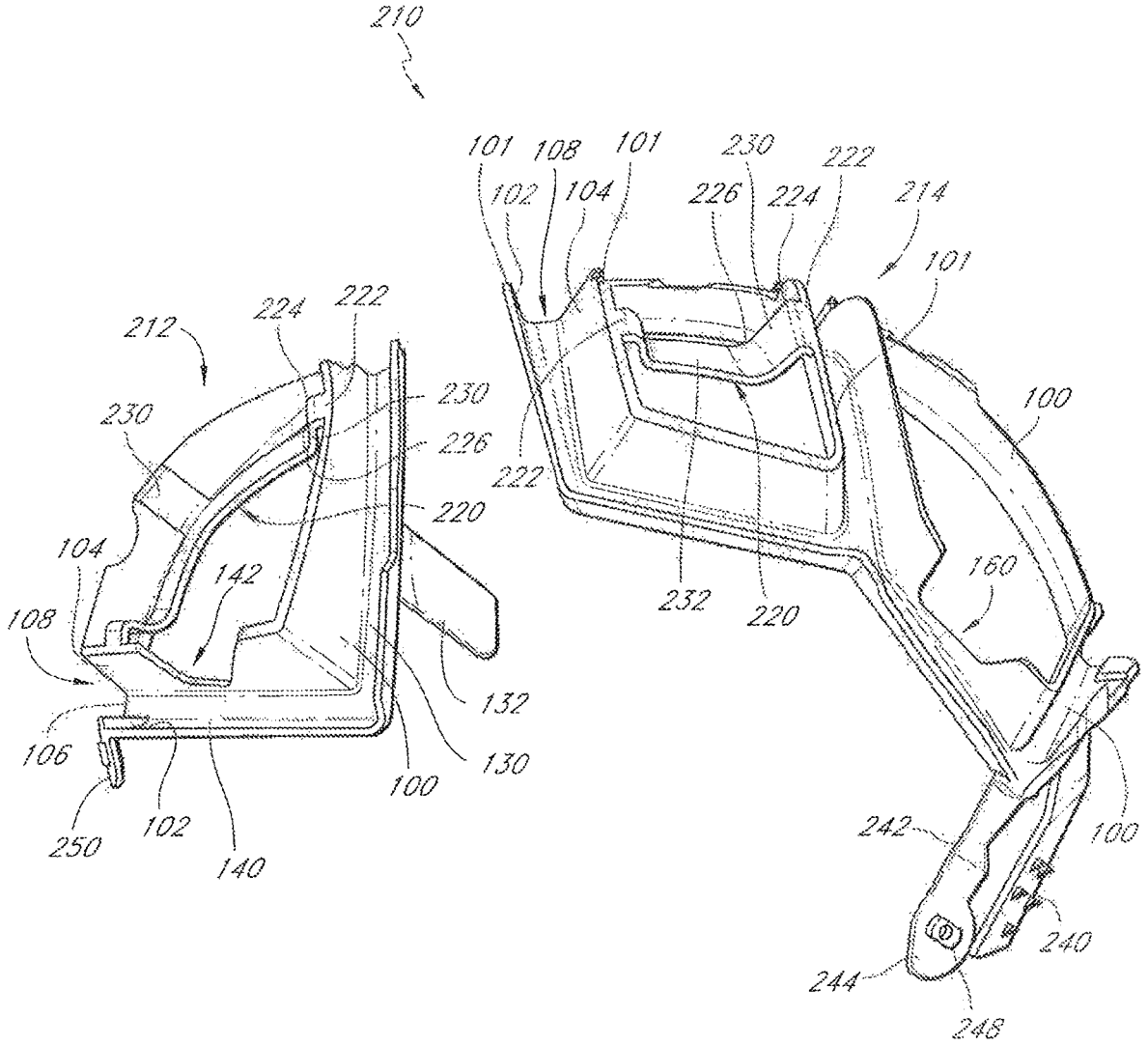
FIG. 11 is a side view of the skeleton of FIG. 10.
Figure 12:
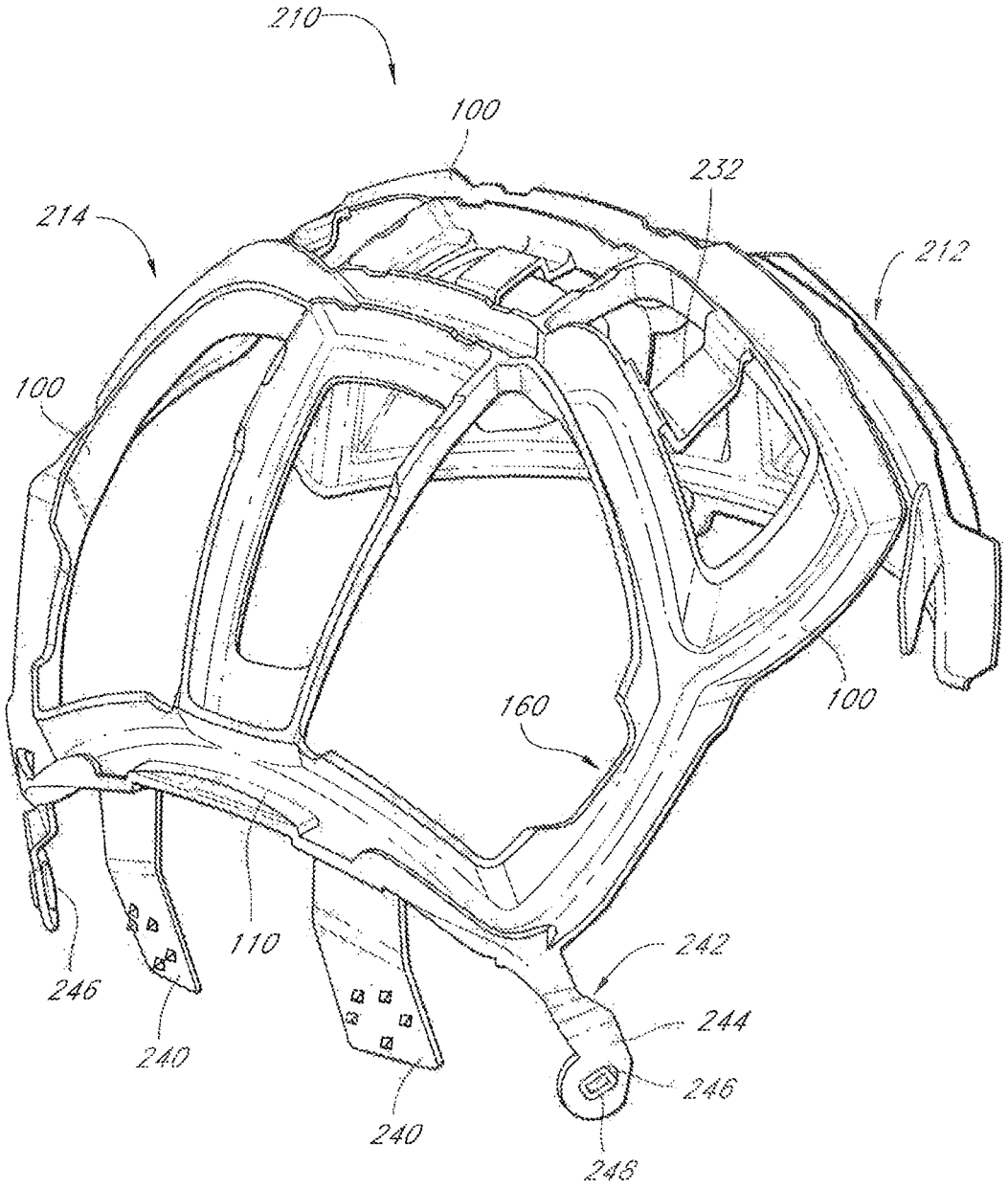
FIG. 12 is a rear perspective view of the skeleton of FIG. 10.

Referring to FIGS. 10 to 12, another embodiment of a skeleton 210 is provided. The skeleton 210 has front and rear 212, 214 portions. As in the embodiment discussed above, the front and rear portions 212, 214 comprise a plurality of members 100 that define channels 108 that accommodate airflow therewithin. In addition to the members 100, a plurality of cross members 220 are included. The cross members 220 do not necessarily define channels therewithin but extend between the skeleton members 100 and provide further reinforcement.

In the illustrated embodiment, the cross members 220 each have multiple connecting ends 222 that attach to one or more of the members 100. Preferably, each of the ends 222 attach at or near the outer edge 101 of the respective first or second projections 102, 104. However, adjacent the connected end 222 the cross member 220 preferably changes direction at a first bend 224 so as to be directed away from the shell surface and toward the player's head. The cross-member then changes direction again at a second bend 226 to define a back portion 232, which is generally aligned with the bottom wall 106 of the members 100 in generally following the contour of a player's head. A similar construction is preferably provided at other connecting ends 222, with first and second bends 224, 226 configured so that the connecting ends 222 attach to the outer edge 101 of the member projections 102, 104. The portion of the cross-member 220 between the first and second bends 224, 226 can be referred to as a transition portion 230.

As in the discussion above in which each of the first and second projections 102, 104 extends upwardly from the bottom wall 106 at an obtuse angle relative to the bottom wall 106 so as to absorb and distribute impact forces by deflecting, the cross members 220 are also constructed so that the transition portions 230 are inclined relative to a tangent of the adjacent shell inner surface, and are thus configured to deflect in a spring-type manner when subjected to impact forces. Thus, the cross-members 220 help absorb local impact forces while simultaneously interconnecting members 100 to increase structural rigidity and even better distribute forces throughout the skeleton 210.

As best seen in FIG. 12, the skeleton 210 has a pair of occipital tabs 240 that depend from the occipital cross member 110 and extend downwardly and are biased inwardly, toward the player's head. These tabs 240 are configured to hold the occipital pad 128, which will be adhered, co-formed, or otherwise attached to the tabs 240. It is to be understood that various types of support structures can be provided depending from the occipital cross member in order to support the occipital pad 128, and in some embodiments the occipital pad 128 may comprise a plurality of pad members.

Referring to FIGS. 10 to 12, an extension portion 242 of the occipital cross member 110 is provided on each side of the rear skeleton 214. A mount tab 244 is provided on the extension portion 242. The mount tab 244 comprises an aperture 246 formed therethrough and supporting a post 248 having an internal threaded hole for receiving a bolt passing through a mount aperture 249 provided on the outer shell 32. Moreover, two mount tabs 250 depend from the front cross-member 140 of the front skeleton portion 212. The mount tabs 250 each have apertures that are each configured to accept a post 254 having an internal threaded hole for receiving a bolt passing through mount apertures 256 provided on the outer shell 32. The mount tabs and posts can be located within the inner lining and/or embedded within the inner lining, if the material of the inner lining is overmolded onto these tabs and posts. This mount structure can help to secure various structures, such as a visor or face guard, which can be, for example, bolted onto the helmet 30.

The above description of the embodiments should not be interpreted in a limiting manner since other variations, modifications and refinements are possible within the spirit and scope of the present invention. The scope of the invention is defined in the appended claims and their equivalents. For example, some embodiments may employ only a skeleton having certain of the skeleton features discussed above, and other embodiments may employ only certain of the ventilation features discussed above, with or without a skeleton, and some embodiments will employ one or more of the features discussed herein but configured in other manners. Accordingly, it should be understood that various features and aspects of the disclosed embodiments can be combined with or substituted for one another in order to form varying modes of the disclosed invention.

The invention claimed is:

1. A helmet for receiving a wearer's head, comprising:

a) a shell having an inner surface facing toward the wearer's head when the helmet is worn, the shell defining a cavity for receiving the wearer's head, wherein left and right temple portions of the inner surface of the shell face left and right temple portions of the wearer's head when the helmet is worn; and b) a self-adjusting fit system residing in the cavity of the helmet, the self-adjusting fit system comprising left and right temporal pads configured to abut against the left and right temple portions of the wearer's head when the helmet is worn, the left temporal pad being located between the left temple portion of the wearer's head and the left temple portion of the inner surface of the shell when the helmet is worn, the right temporal pad being located between the right temple portion of the wearer's head and the right temple portion of the inner surface of the shell when the helmet is worn, each temporal pad being deflectable relative to the corresponding temple portion of the inner surface of the shell between a first position and a second position, in the first position the temporal pad being closer to the corresponding temple portion of the inner surface of the shell than in the second position;

wherein the self-adjusting fit system is configured to bias the temporal pads so as to press against the left and right temporal portions of the wearer's head both in the first position and in the second position.

2. The helmet of claim 1, further comprising an inner lining attached to the inner surface of the shell, each of the left and right temporal pads being mounted adjacent to the inner lining.

3. The helmet of claim 2, wherein the self-adjusting fit system is configured such that, in use, when the wearer dons the helmet, each said temporal pad is movable relative to the inner lining.

4. The helmet of claim 2, wherein each of the left and right temporal pads is an extension of the inner lining.

5. The helmet of claim 2, wherein the shell comprises a plurality of shell members, the plurality of shell members being movable relative to one another to vary a dimension of the cavity of the helmet.

6. The helmet of claim 5, wherein the inner lining includes a plurality of portions attached to respective shell members of the plurality of shell members, the portions of the inner lining being movable relative to one another when the respective shell members move relative to each other.

7. The helmet of claim 6, wherein the portions of the inner lining comprise at least a front portion and a rear portion.

8. The helmet of claim 1, wherein the self-adjusting fit system comprises left and right temporal members extending along respective left and right temporal regions of the helmet.

9. The helmet of claim 8, wherein each temporal member includes semi-rigid material.

10. The helmet of claim 9, Wherein the semi-rigid material is injection-molded polymer.

11. The helmet of claim 8, wherein each of the temporal members is movable relative to the inner surface of the shell.

12. The helmet of claim 11, wherein movement of the temporal members pairs with the deflection of the temporal pads.

13. The helmet of claim 12, wherein the temporal pads are connected to the temporal members.

14. The helmet of claim 13, wherein the temporal pads are overmolded onto the temporal members.

15. The helmet of claim 13, wherein the temporal pads are bonded to the temporal members.

16. The helmet of claim 1, wherein each of the temporal pads is affixed to the shell.

17. The helmet of claim 2, wherein the self-adjusting fit system is covered at least in part by the inner lining.

18. The helmet of claim 1, wherein each temporal pad is biased to extend inwardly up to at least ⅛ inch from the inner surface of the shell in the second position.

19. The helmet of claim 1, wherein each temporal pad is biased to extend inwardly up to at least ¼ inch from the inner surface of the shell in the second position.

20. The helmet of claim 1, wherein each temporal pad is biased to extend inwardly up to at least ½ inch from the inner surface of the shell in the second position.

21. The helmet of claim 1, further comprising:

an occipital pad mounted in a rear region of the helmet, the occipital pad configured to abut against a lower portion of the wearer's head when the helmet is worn, the occipital pad being deflectable relative to the shell between a first position and a second position, in the first position the occipital pad being closer to the inner surface of the shell than in the second position.

22. The helmet of claim 21, further comprising an inner lining attached to the inner surface of the shell, wherein the occipital pad is affixed to the inner lining.

23. The helmet of claim 21, wherein the occipital pad is affixed to the shell.

24. The helmet of claim 21, wherein the self-adjusting fit system is configured to bias the occipital pad so as to press against the lower portion of the wearer's head both in the first position and in the second position.

25. The helmet of claim 24, wherein the self-adjusting fit system further comprises:

an occipital member extending transversally across the rear region of the helmet; and a support member depending downwardly from the occipital member, the occipital member and the support member being connected to one another.

26. The helmet of claim 25, wherein the support member and the occipital member are unitarily molded together.

27. The helmet of claim 25, the occipital member being adjacent to the inner surface of the shell and connected to the shell.

28. The helmet of claim 25, wherein the occipital pad is connected to the support member.

* * * * *